United States Patent [19]

Marii et al.

[11] Patent Number: 4,883,006

[45] Date of Patent: Nov. 28, 1989

[54] AUTOMATIC SEWING MACHINE

[75] Inventors: Satoshi Marii, Nagoya; Kunihiko Murata, Tsushima; Hiroyuki Mitsui, Kasugai, all of Japan

[73] Assignee: Brother Kogyo Kabushiki Kaisha, Japan

[21] Appl. No.: 181,531

[22] Filed: Apr. 14, 1988

[30] Foreign Application Priority Data

Apr. 24, 1987 [JP] Japan ..... 62-102755

[51] Int. Cl.[4] ..... D05B 21/00

[52] U.S. Cl. ..... 112/121.12; 112/121.14

[58] Field of Search ..... 112/121.14, 121.15, 112/121.12, 104, 114, 265.1, 262.3, 2, 103; 223/38

[56] References Cited

U.S. PATENT DOCUMENTS

| | | | |
|---|---|---|---|
| 3,143,091 | 8/1964 | Arbter | 112/2 |
| 3,528,378 | 9/1970 | Westhoff et al. | 112/121.15 |
| 3,552,336 | 1/1971 | Brandriff et al. | 112/121.15 |
| 3,713,406 | 1/1973 | Futter | 112/121.15 |
| 3,783,809 | 1/1974 | Marforio | 112/121.14 |
| 4,445,631 | 5/1984 | Olivares | 112/121.15 X |
| 4,493,276 | 1/1985 | Sadeh | 112/121.12 |
| 4,503,789 | 3/1985 | Scholl | 112/121.14 |
| 4,512,269 | 4/1985 | Bowditch | 112/121.14 X |
| 4,513,677 | 4/1985 | Scholl | 112/121.14 X |
| 4,557,206 | 12/1985 | Iwase | 112/121.4 |
| 4,669,405 | 6/1987 | Resta et al. | 112/103 X |
| 4,685,407 | 8/1987 | Junemann | 112/121.14 X |
| 4,696,242 | 9/1987 | Scholl et al. | 112/121.14 |

FOREIGN PATENT DOCUMENTS

| | | |
|---|---|---|
| 3329087 | 2/1985 | Fed. Rep. of Germany . |
| 3407338 | 6/1985 | Fed. Rep. of Germany . |
| 63-255094 | 10/1988 | Japan . |
| 63-255095 | 10/1988 | Japan . |
| 63-255096 | 10/1988 | Japan . |
| 63-255097 | 10/1988 | Japan . |

*Primary Examiner*—Peter Nerbun
*Attorney, Agent, or Firm*—Oliff & Berridge

[57] ABSTRACT

The automatic sewing machine includes a workpiece moving means for moving a workpiece in a predetermined direction and a sewing head moving means for moving a sewing head (at least a needle and a loop taker) in a direction perpendicular to the predetermined direction. The workpiece moving means is designed to be moved independently of the sewing head moving means, thus simplifying the general structure of these moving means.

7 Claims, 10 Drawing Sheets

DATA D(J)

| | | |
|---|---|---|
| SIGN OF X | SIGN OF Y | CONTROL CODE |
| X-AXIS MOVEMENT ΔX | | |
| Y-AXIS MOVEMENT ΔY | | |

FIG.9

AUTOMATIC SEWING MACHINE

BACKGROUND OF THE INVENTION

The present invention relates to an automatic sewing machine wherein a stitch path is controlled automatically by varying a relative position between a needle and a workpiece;

In this type of conventional automatic sewing machine, the relative position between the needle and the workpiece is varied in such a manner that the workpiece is moved relative to the reciprocal path of the needle in respect of a horizontal direction, or the reciprocal path of the needle is moved relative to the workpiece fixed in respect of the horizontal direction. Generally, for the purpose of forming stitch pattern which has two-dimensional shape, it is required to vary the position of the workpiece relative to the reciprocal path of the needle in biaxial directions in a horizontal plane. In the conventional automatic sewing machine as disclosed in U.S. Pat. Nos. 4,513,677, 3,552,336 and 3,713,406, for example, a first moving means (X-direction moving means, for example) for moving the sewing head or the workpiece and a second moving means (Y-direction moving means, for example) are arranged at right angles in such a manner that the X-direction moving means is mounted on the Y-direction moving means. Thus, the movement of the sewing head or the workpiece in the Y-direction is effected by the Y-direction moving means, and the movement of the sewing head or the workpiece in the X-direction is effected by the X-direction moving means on the Y-direction moving means. Accordingly, the structure of the X-direction and Y-direction moving means is complicated. Further, the mass to be moved by the Y-direction moving means includes not only the mass of the sewing head or the workpiece clamping means but also the mass of the X-direction moving means, causing an increased inertia. To cope with this increased inertia, it is necessary to make a response speed large and therefore to provide a large driving means. In addition, as both the moving means are cooperatively connected, vibration or deflection generated in the Y-direction moving means directly affects a positioning accuracy in the X-direction.

Some of the conventional automatic sewing machine have a preparing area for preparing a workpiece prior to a sewing operation and a sewing area where the sewing operation is carried out. In this type of sewing machine the workpiece prepared in the preparing area is required to be transferred to the sewing area. Accordingly, it is required to provide a workpiece transferring means in addition to the moving means for varying the relative position between the needle and the workpiece during the sewing operation. There is disclosed this type sewing machine having a mechanism serving as both the workpiece transferring means and the moving means during the sewing operation in U.S. Pat. No. 3,528,378. In this type of sewing machine, the moving means for varying the relative position between the needle and the workpiece is required to have a length in at least X- or Y-direction enough to transfer the workpiece from the preparing area to the sewing area. Accordingly, the moving means extending from the preparing area to the sewing area is long and tends to be vibrated or deflected. The vibration or deflection in one-direction moving means causes bad influence to the other-direction moving means thereon to make the stitch pattern inaccurate. To cope With this problem, the automatic sewing machine is rendered larger and more complicated.

SUMMARY OF THE INVENTION

It is an object of the present invention to provide an automatic sewing machine which solves the above problems caused by the structure that the X-direction moving means is moved by the Y-direction moving means.

It is another object of the present invention to provide an automatic sewing machine which solves the above problem caused by an increased moving distance of the workpiece in a type having a combined mechanism of the workpiece transferring means and the moving means for relatively moving the needle and the workpiece.

The automatic sewing machine according to the present invention includes a workpiece moving means of moving a workpiece in a predetermined direction and a sewing head moving means for moving a sewing head (at least a needle and a loop taker) in a direction intersecting the predetermined direction. It is preferable that the sewing head is moved in a direction perpendicular to the workpiece moving direction. However, it is not necessary that the sewing head is moved in the perpendicular direction.

According to the present invention, both the workpiece moving means and the sewing head moving means are designed to be moved independently, thus simplifying the general structure of these moving means. The mass to be moved by each moving means is a workpiece clamping means or a sewing head only, thereby reducing the inertia to be moved by the moving means. Further, the vibration or deflection in one of these moving means is prevented from directly affect the other moving means.

The invention will be more fully understood from the following detailed description and appended claims when taken with the drawings.

BRIEF DESCRIPTION OF THE DRAWINGS

FIG. 9 is an illustration of the sewing data.

DETAILED DESCRIPTION OF THE PREFERRED EMBODIMENT

There will now be described a preferred embodiment of the present invention with reference to the drawings.

Figure 1:
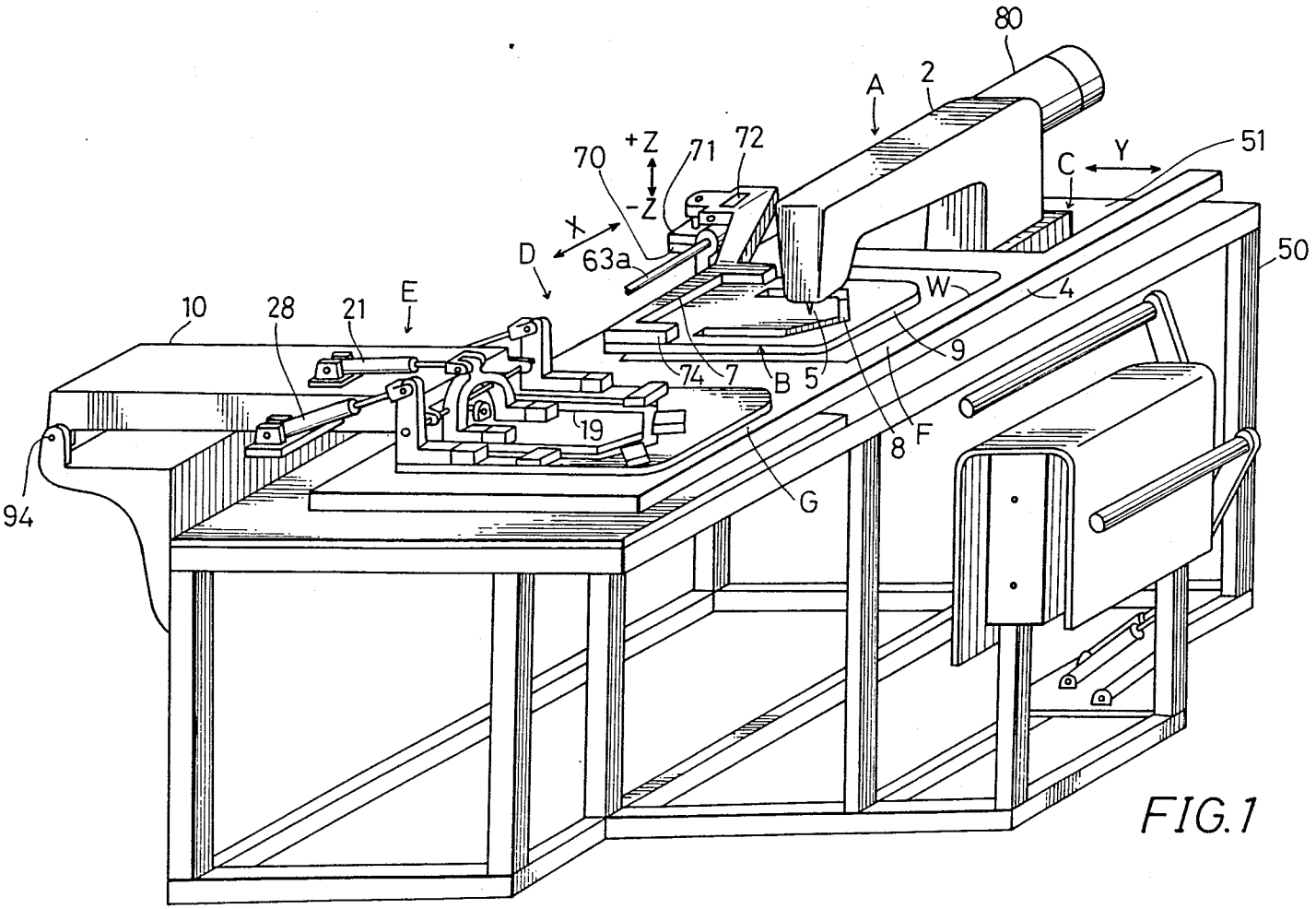
FIG. 1 is a schematic perspective view of a preferred embodiment of the automatic sewing machine according to the present invention.
Figure 2:
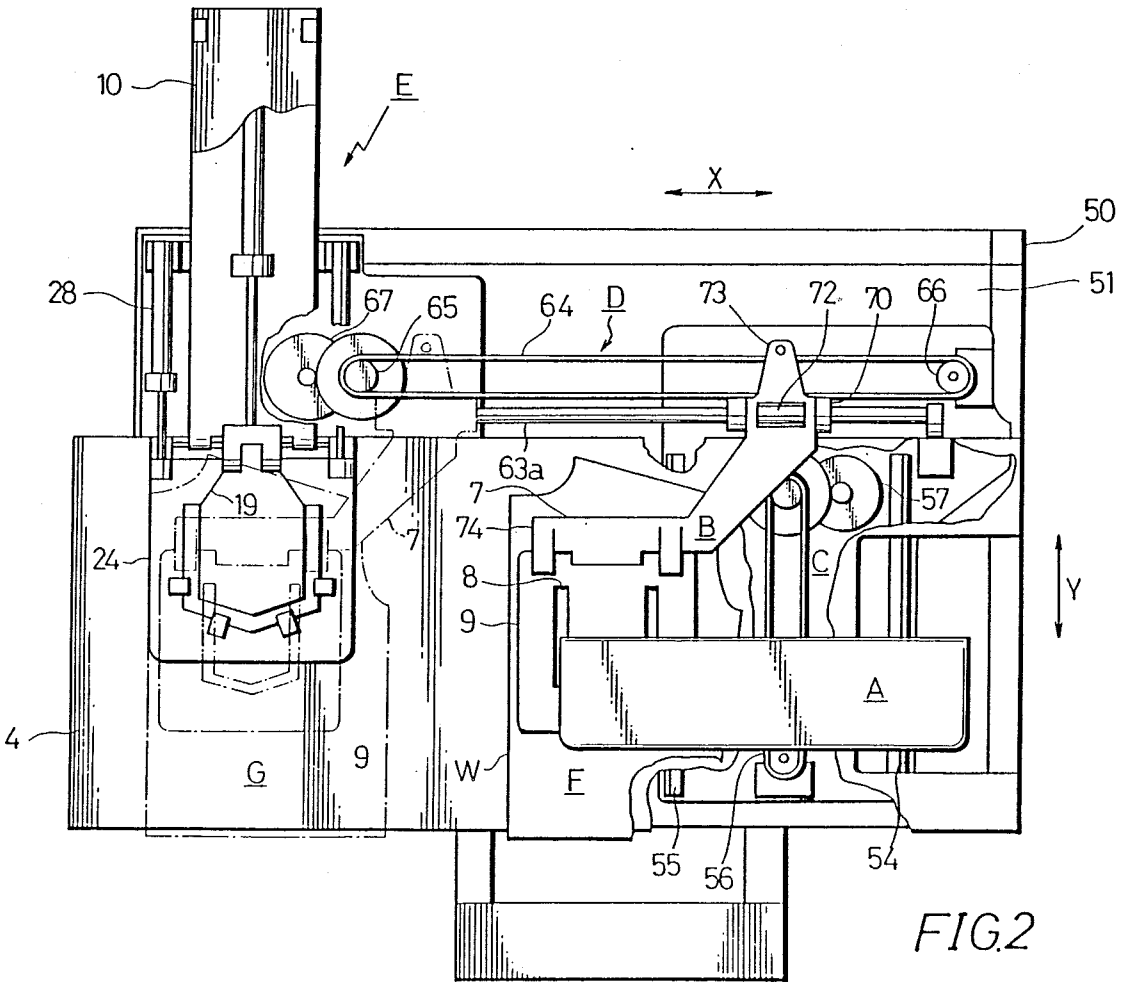
FIG. 2 is a plan view of the essential part of the automatic sewing machine shown in FIG. 1.

As shown in FIGS. 1 and 2, the automatic sewing machine generally comprises a sewing head A for carrying out a sewing operation, a sewing head moving means C for moving the sewing head A in the directions of Y-axis shown by a double-headed arrow, a clamping means B for retaining a workpiece, that is, a work fabric W and a pocket piece P (FIG. 5), a clamp moving means D for moving the clamping means B in the directions of X-axis shown by a double-headed arrow, and a pocket folding device E for folding back a marginal portion of the pocket piece P (See FIG. 5).

The automatic sewing machine has a frame 50 for mounting the above-mentioned mechanism thereon. The frame 50 mounts a workpiece supporting table 4 thereon. The workpiece supporting table 4 provides a common operation surface for the pocket folding device E and the sewing head A, and includes a throat plate (not shown) of the sewing head A. The workpiece supporting table 4 has a workpiece preparing area G where the marginal portion of the pocket piece P is folded and located on the work fabric W such as a shirt front prior to a sewing operation and has a sewing area F where the sewing operation is carried out by the sewing head A.

Figure 3:
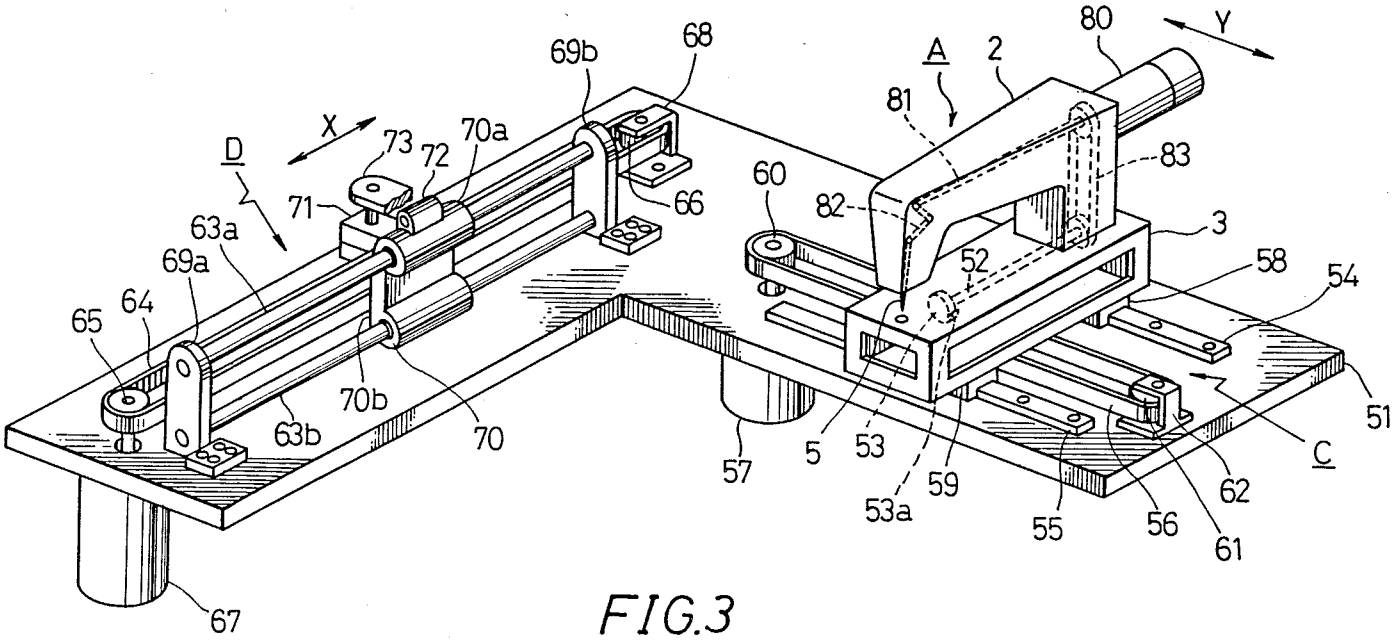
FIG. 3 is a perspective view of the sewing head moving means and the clamp moving means of the automatic sewing machine shown in FIG. 1.

Referring to FIG. 3, the sewing head A has an arm portion 2 for vertically movably supporting a needle 5 and has a bed portion 3 for supporting the arm portion 2. The bed portion 3 is mounted on a base 51 fixed to the frame 50 in such a manner as to be movable in the directions of Y-axis shown by a double-headed arrow. While the workpiece supporting table 4 is not shown in FIG. 3, the bed portion 3 is adapted to be moved in the Y-direction under the sewing machine table 4 as shown in FIG. 1. The needle 5 is vertically driven through a link mechanism 82 and an upper horizontal shaft 81 by means of a sewing machine motor 80. The bed portion 3 includes therein a lower horizontal shaft 52 arranged in parallel to the X-axis and adapted to be rotated in synchronism with the upper horizontal shaft 81 through a timing belt 83 by the rotation of the upper horizontal shaft 81. The lower shaft 52 is provided at its end with a loop taker 53 adapted to be rotated about the X-axis.

The sewing head moving means C generally comprises a pair of track rails 54 and 55 arranged in parallel to the Y-axis on the base 51, a timing belt 56 and a Y-axis motor 57 for driving the timing belt 56. The bed portion 3 is provided at its bottom surface with a pair of U-shaped bearings 58 and 59 engaging with the track rails 54 and 55, respectively. The timing belt 56 is stretched in the direction of Y-axis by means of a pair of timing pulleys 60 and 61. The timing pulley 61 is rotatably mounted through a pulley supporting member 62 on the base 51, while the timing pulley 60 is operatively connected to a rotating shaft of the Y-axis motor 57 fixed to the base 51. The timing belt 56 is fixed at a position by a screw to the bottom surface of the bed portion 3.

In operation, when the Y-axis motor 57 is rotated, the timing belt 56 is driven through the pulley 60 to move the bed portion 3 in the directions of Y-axis as the bed portion 3 being guided by the track rails 54 and 55. Thus, the sewing head A and therfore the needle 5 as well as the loop taker 53 can be moved in the directions of Y-axis in the sewing area F of the workpiece supporting table 4.

In the sewing area F, the pocket piece P and the work fabric W clamped by the clamping means B are sewn to each other. As shown in FIGS. 1, 2 and 3, the clamping means B generally comprises a clamping cylinder 71, a feeding arm 7, and a feeding plate 9 having a needle guide channel 8. The feeding arm 7 is pivotally supported on a bearing 72 provided at a top portion 70*a* of a movable member 70. A rear end portion 73 of the feeding arm 7 is operatively connected to a piston of the clamping cylinder 71 fixed to a rear surface 70*b* of the movable member 70. The feeding plate 9 is detachably mounted to a pair of forked front ends 74 of the feeding arm 7.

. In operation, when the clamping cylinder 71 is driven in the directions of Z-axis shown by a double-headed arrow in FIG. 1, the feeding arm 7 is rocked about the bearing 72 like a fulcrum. That is to say, when the piston of the clamping cylinder 71 is driven in the direction of +Z, the feeding arm 7 is rocked downwardly to make the feeding plate 9 press the work fabric W and the pocket piece P against the workpiece supporting table 4 and clamp both the work fabric W and the pocket piece P. On the contrary, when the piston of the clamping cylinder 71 is driven in the direction of −Z, the feeding arm 7 is rocked upwardly to make the feeding plate 9 unclamp the work fabric W and the pocket piece P.

As shown in FIGS. 2 and 3, the clamping means B is adapted to be moved in the directions of X-axis shown by a double-headed arrow by the clamp moving means D. The clamp moving means D generally comprises the movable member 70, a pair of rails 63*a* and 63*b*, a timing belt 64 and an X-axis motor 67. The movable member 70 pivotally supports the feeding arm 7 at the bearing 72, and is slidably supported by the rails 63*a* and 63*b* extending along the X-axis and retained by a pair of rail supporting members 69*a* and 69*b* fixed on the base 61. The timing belt 64 is stretched in the directions of X-axis by a pair of timing pulleys 65 and 66. The timing pulley 65 is operatively connected to a rotating shaft of the X-axis motor 67 fixed to the base 51, while the timing pulley 66 is rotatably mounted through a pulley supporting member 68 on the base 51. The timing belt 64 is fixed at a position by a screw to the rear surface 70*b* of the movable member 70.

In operation, when the X-axis motor 67 is rotated, the timing belt 64 is driven through the pulley 65 to move the movable member 70 in the directions of X-axis as the movable member 70 being guided by the rails 63*a* and 63*b*. Accordingly, the feeding plate 9 connected through the feeding arm 7 and the bearing 72 to the movable member 70 can be moved in the directions of X-axis.

As shown in FIG. 2, the clamp moving means D is located on the base 51 so that the feeding plate 9 may be moved on the workpiece supporting table 4 between the preparing area G and the sewing area F. Accordingly, the pocket piece P and the work fabric W are clamped at the preparing area G between the feeding plate 9 and the workpiece supporting table 4, and then they are slidingly fed on the workpiece supporting table 4 to the sewing area F under the clamped condition. As will be hereinafter described, the clamp moving means D also acts to move the work fabric W and the pocket piece P in association with the sewing operation. That is, the clamp moving means D controls the location of the work fabric W and the pocket piece P with respect to the needle in the X-direction to thereby control a sewing path. As mentioned above, the transferring of the work fabric W and the pocket piece P from the preparing area G to the sewing area F and the X-direction control of the sewing path are effected by the single clamp moving means D.

Figure 4:
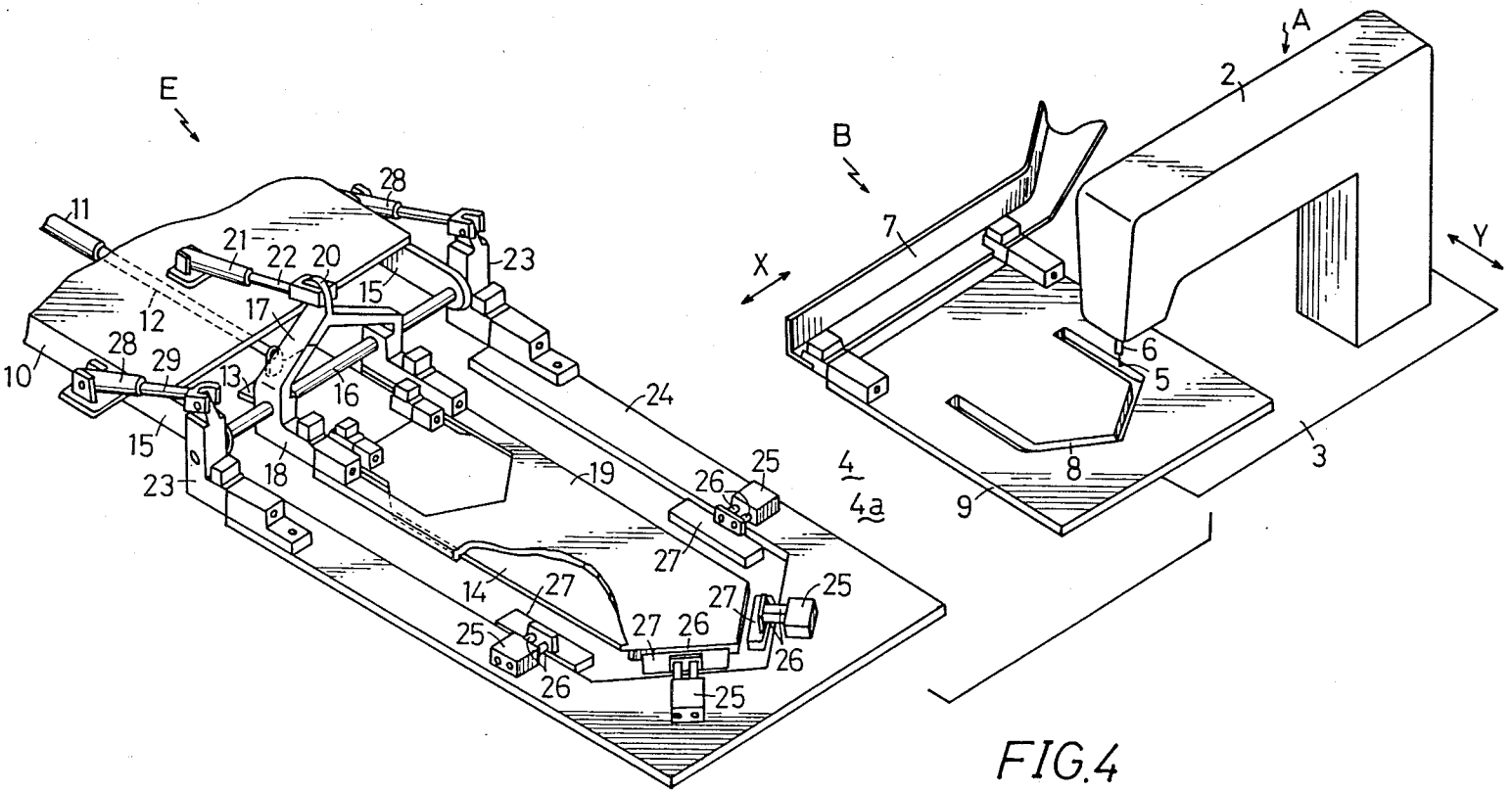
FIG. 4 is a perspective view of the pocket folding device and the sewing head of the automatic sewing machine shown in FIG. 1.

As shown in FIG. 4, the pocket folding device E for folding the marginal portion of the pocket piece P in the preparing area G generally comprises a gauge plate 14, a presser plate 19, a folding member mount plate 24, a plurality of folding members 27 and air cylinders 11, 21, 28 and 25 for driving these members.

A supporting member 10 is rotatably supported by an air cylinder (not shown) about a horizontal axis 94 (See FIG. 1). The air cylinder 11 for driving the gauge plate 14 is mounted on the lower surface of the supporting member 10, and a piston 12 of the air cylinder 11 is connected at its one end with a gauge plate support 13 located on the front side of the supporting member 10. The gauge plate 14 for determining an external shape of the pocket piece P is detachably mounted to the gauge plate support 13, and the pocket piece P is adapted to be put on the gauge plate 14. The gauge plate 14 is operated by the piston 12 to be advanced onto the workpiece supporting table 4 and be retracted to the underside of the supporting member 10. The supporting member 10 is formed at its front end with a pair of shaft supports 15 projecting frontwardly, and a horizontal support shaft 16 is supported to the shaft supports 15. A presser plate support 17 is rotatably mounted on the support shaft 16. The presser plate support 17 is formed with a pair of mount portions 18 projecting frontwardly for detachably mounting the presser plate 19. The presser plate support 17 is further formed with a connecting portion 20 projecting upwardly at an upper central position thereof. The connecting portion 20 is connected to a piston 22 of the air cylinder 21 rotatably mounted on the upper surface of the supporting member 10. When the piston 22 is operated to advance and retract, the presser plate 19 is rotated between an operative position where it is superimposed on the gauge plate 14 and an inoperative position where it is separated from the gauge plate 14.

A pair of supporting blocks 23 are rotatably supported at both ends of the support shaft 16, and a substantially U-shaped folding member mount plate 24 is detachably mounted to the front ends of the supporting blocks 23. Four air cylinders 25 are mounted on the folding member mount plate 24 at positions as to surround the front end portion of the presser plate 19. Each of the folding members 27 is mounted to a piston 26 of each air cylinder 25. When the pistons 26 are operated to advance and retract, the folding members 27 are moved between an operative position where they extend to the underside of the gauge plate 14 and an inoperative position where they retract from the gauge plate 14.

A pair of air cylinders 28 are provided between opposite sides of the supporting member 10 and the upper ends of the supporting blocks 23. A base of each air cylinder 28 is rotatably connected to the supporting member 10, and a piston 29 of each air cylinder 28 is connected to the upper end of each supporting block 23.

Figure 6:
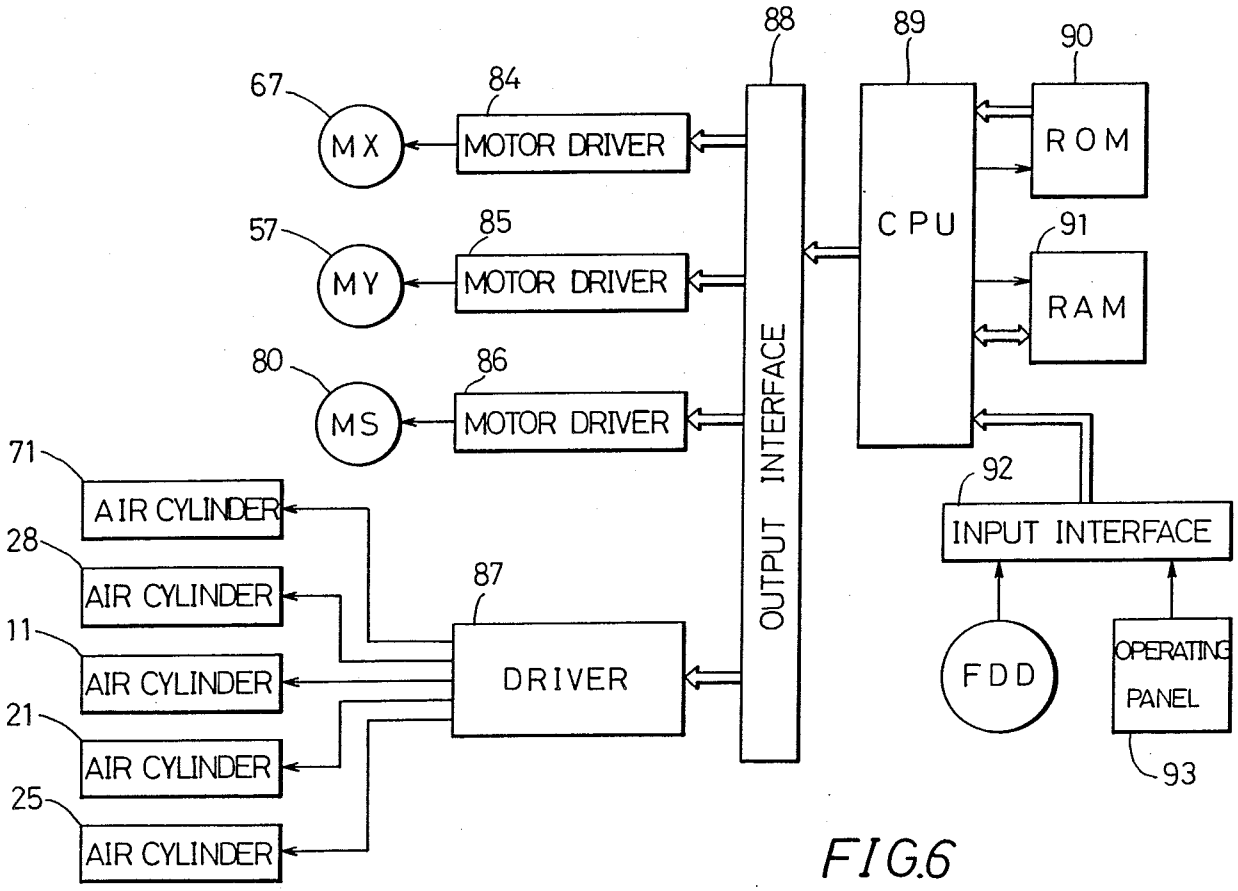
FIG. 6 is a block diagram of the control device for the automatic sewing machine.

FIG. 6 shows a control device for controlling the X-axis motor 67, the Y-axis motor 57, the clamping air cylinder 71, the sewing head A, the pocket folding device E, etc.

A motor driver 84 for driving the X-axis motor 67, a motor driver 85 for driving the Y-axis motor 57, a motor driver 86 for driving the sewing machine motor 80, a driver 87 for driving the air cylinders 71, 28, 11, 21 and 25 are connected through an output interface 88 to a central processing unit (which will be hereinafter referred to as a CPU) 89. The CPU 89 is connected to a ROM 90 storing a working control program and a RAM 91 for loading a stitch data from a floppy disc drive FDD and storing the same loaded. An operating panel 93 having bottom switches for inputting various operations and the floppy disc drive FDD storing the stitch data are connected through an input interface 92 to the CPU 89.

Figure 7:
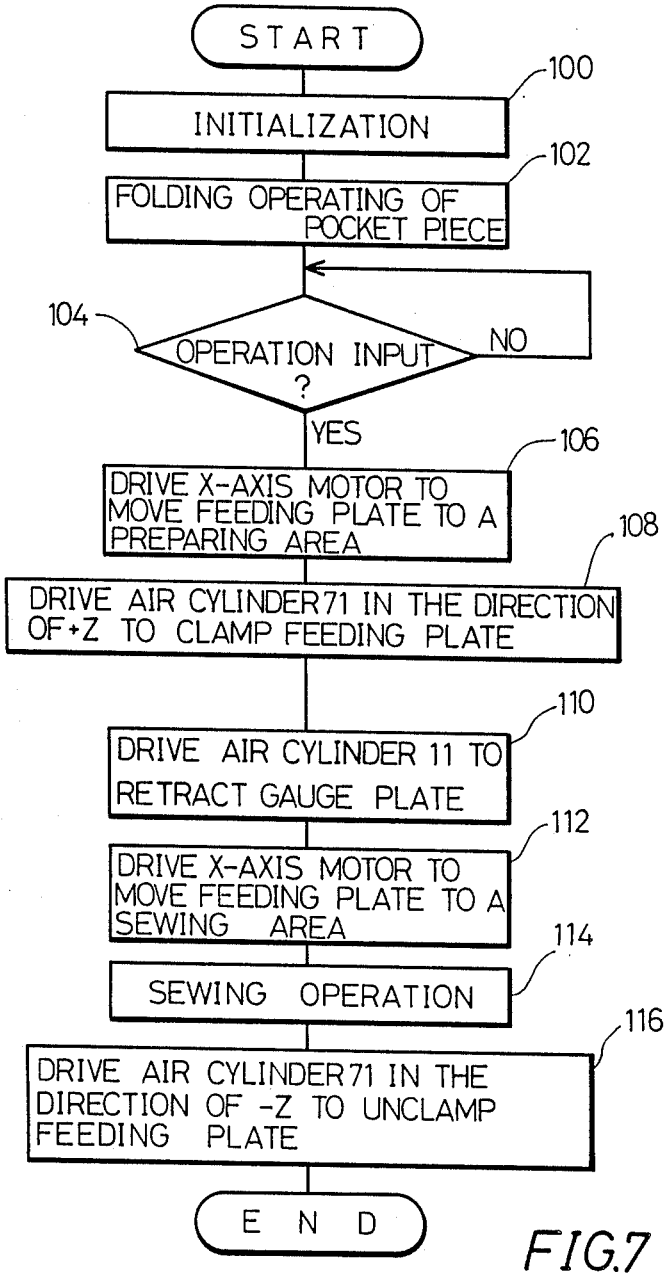
FIGS. 7 and 8 are flow charts of the operation of the CPU in the control device.

FIG. 7 is a flow chart showing the operation of the CPU 89. When a start switch on the operating panel 93 is depressed, the operation is started from step 100. In step 100, the sewing head A and the clamping means B are located at an original position under an unclamped condition, and each cylinder of the pocket folding device E is initialized. Then, the program proceeds to step 102 where the cylinders 28, 11, 21 and 25 of the pocket folding device E are sequentially driven by depressing an operating switch on the operating panel 93 to fold the marginal portion of the pocket piece.

Figure 5A:
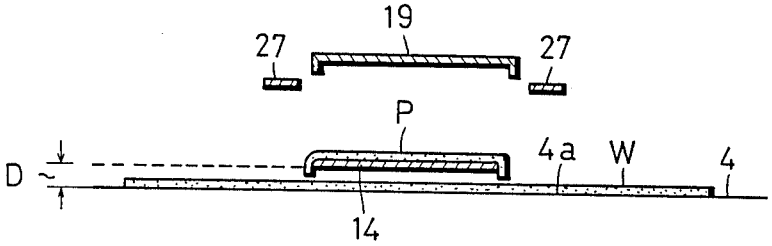
FIGS. 5A to 5H are illustrations of the operation of the pocket folding device.

In step 102, as shown in FIG. 5A, the supporting member 10, the gauge plate 14, the presser plate 19 and the folding member mount plate 24 are lifted to locate the gauge plate 14 at a waiting position apart by a predetermined distance D from a workpiece supporting surface 4*a* of the workpiece supporting table 4. In this stage, the folding member mount plate 24 and the presser plate 19 are lifted higher than the gauge plate 14. Under the condition, the work fabric W is mounted on the workpiece supporting surface 4*a* below the gauge plate 14, and the pocket piece P is mounted on the gauge plate 14.

Figure 5B:
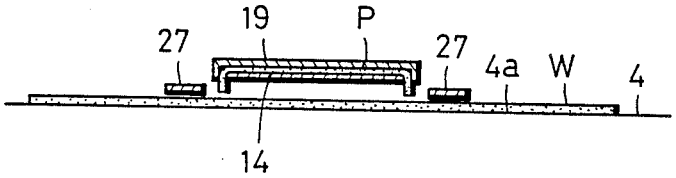
Figure 5C:
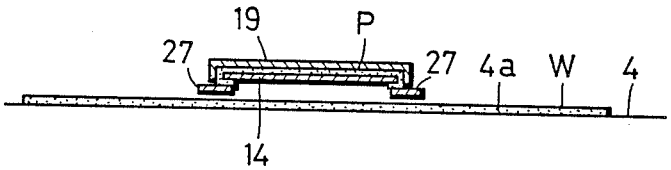

Then, the air cylinders 21 and 28 are operated to lower the presser plate 19 and the folding member mount plate 24 and superimpose the presser plate 19 on the gauge plate 14 to thereby fold the marginal portion of the pocket piece P downwardly along the outer periphery of the gauge plate 14 as shown in FIG. 5B. Then, each air cylinder 25 is operated to move each folding member 27 to the downside of the gauge plate 14, thereby inwardly folding the marginal portion of the pocket piece P in such a manner as to come into contact with the lower surface of the gauge plate 14 as shown in FIG. 5C.

Figure 5D:
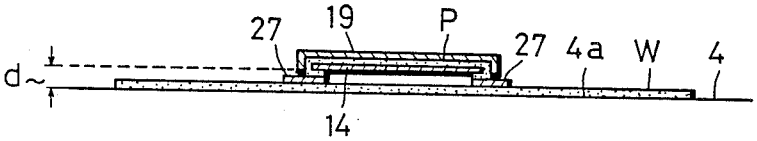
Figure 5E:
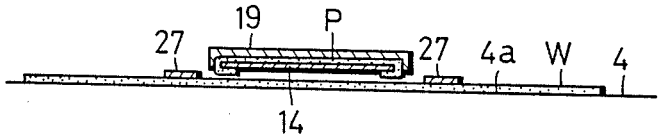
Figure 5F:
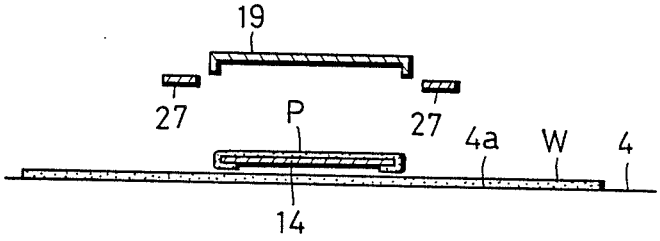

Then, as shown in FIG. 5D, the supporting member 10 and each plate 14, 19 and 24 are lowered until the distance between the workpiece supporting surface 4*a* and the gauge plate 14 becomes a predetermined distance d smaller than the distance D, and as shown in FIG. 5E, each folding member 27 is retracted from the pocket piece P. Then, as shown in FIG. 5F, the air cylinders 28 and 21 are operated to lift the folding member mount plate 24 and the presser plate 19, thereby making the same separated from the pocket piece P.

After the above operation is ended, the program proceeds to step 104 in FIG. 7 where it is determined whether or not an operating switch of the operating panel 93 has been depressed. If YES, the program proceeds to step 106, and starts executing a feeding operation of the work fabric.

Figure 5G:
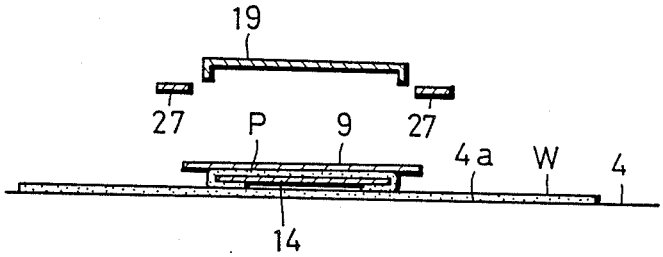

In step 106, the X-axis motor 67 is driven by a predetermined amount to move the feeding plate 9 from the original position (sewing area) to the working position (preparing area) under an unclamped condition. The feeding plate 9 is initially set in a position higher than the gauge plate 14 and lower than the presser plate 19 shown in FIG. 5F. In step 108, the piston of the clamping air cylinder 71 is driven in the direction of +Z to make the feeding plate 9 press the gauge plate 14 and the pocket piece P on the work fabric W as shown in FIG. 5G.

Figure 5H:
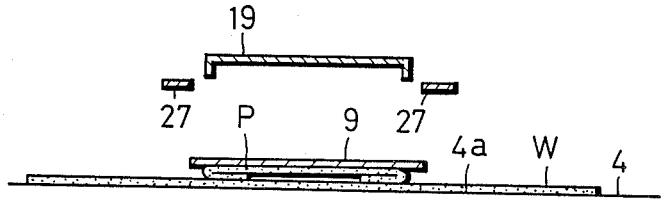

Then, in step 110, the air cylinder 11 is driven to move the gauge plate 14 rearwardly and draw the same from the pocket piece P as shown in FIG. 5H. In step 112, the X-axis motor 67 is driven by a predetermined amount under the clamped condition of the feeding plate 9 to move the same to the sewing area F. As a result, the folded pocket piece P and the work fabric W are fed to the sewing area F on the workpiece supporting table 4.

Then, in step 114, while the feeding plate 9 is maintained under the clamped condition, the X-axis motor 67 and the Y-axis motor 57 are controlled to be rotated in synchronism with the reciprocal movement of the needle 5 according to the sewing data, and a sewing operation is carried out according to a programmed sewing path along the edge of the folded pocket piece P. In the sewing operation, the needle 5 is vertically reciprocated through and along the needle guide channel 8.

Figure 8:
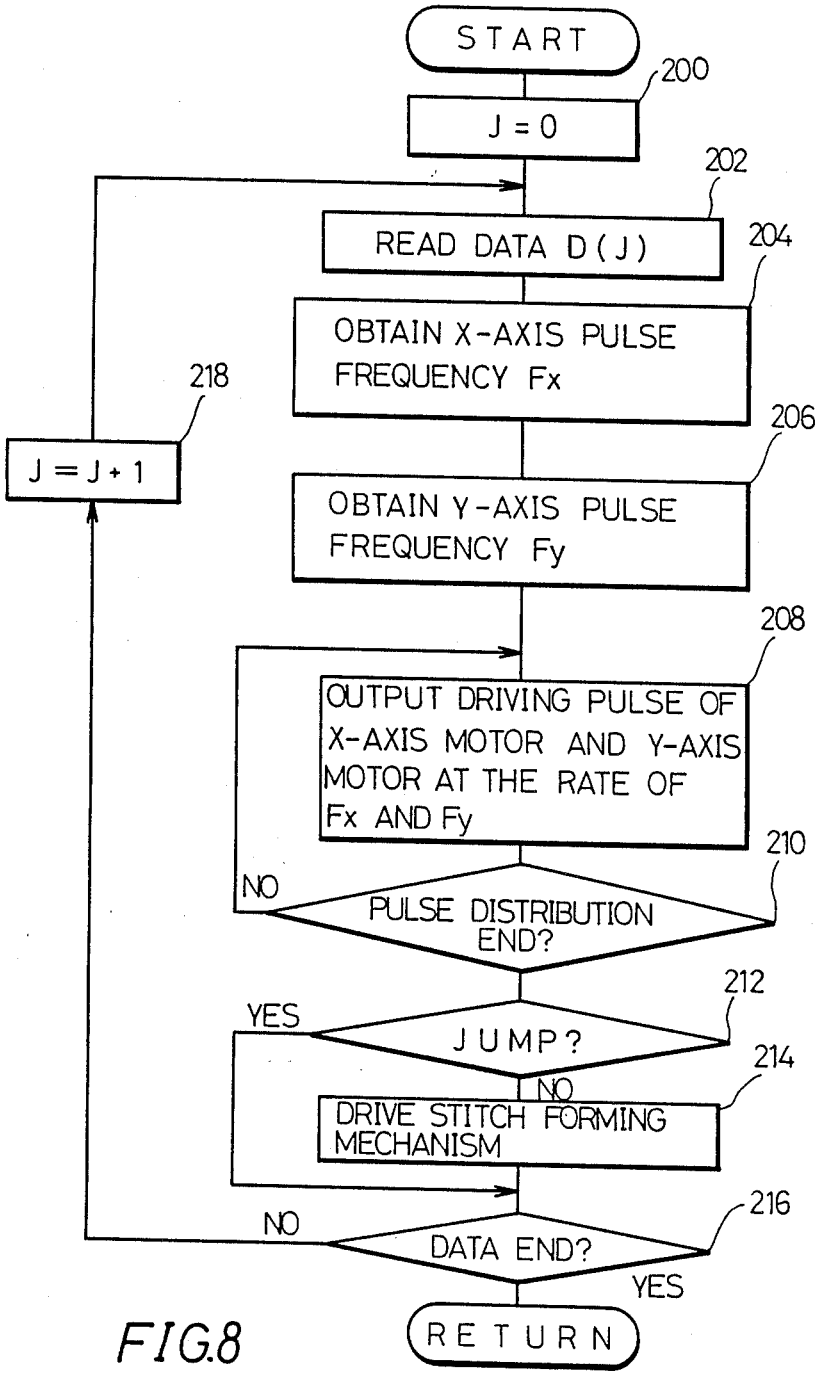

FIG. 8 shows a flow chart of the sewing operation. In step 200, a data block number J is initialized, and in step 202, one data block D(J) in the sewing data stored as shown in FIG. 9 is read into RAM 91. Referring to FIG. 9, ΔX denotes the movement of the feeding plate 9 in the X-direction, and ΔY denotes the movement of the sewing head A. The signs of X and Y mean negative or positive movement. The control code includes a jump command, and if the jump command is effective, no stitch is formed, but the movements of ΔX and ΔY are executed.

In step 204, an X-axis pulse frequency Fx is obtained. The number of pulses required for executing the movement of ΔX is calculated according to a program stored in ROM 90, and a period of time from the timing when the needle is upwardly moved away from the work fabric to the timing when the needle is downwardly moved to reach the work fabric is measured. Thus, the X-axis pulse frequency Fx to be applied to the X-axis pulse motor 67 is obtained from the number of pulses and the period of time as obtained above. Similarly, in step 206, a Y-axis pulse frequency Fy to be applied to the Y-axis pulse motor 57 is obtained. Then, the pulses with the frequencies Fx and Fy are output to the X-axis and Y-axis motors 67 and 57 at a timing in concert with the vertical motion of the needle 5 in the rotating direction according to the signs of X and Y. Then, in step 210, it is determined whether or not the required number of pulses has been output. If YES, it is determined that the movements of ΔX and ΔY have been ended, and the program proceeds to step 212 where the control code is decoded and it is determined whether or not it is a jump command. If NO, the program proceeds to step 214 where a stitch forming mechanism including the needle 5 and the loop taker 53 is driven by one cycle to thereby form a stitch. If YES in step 212, no stitch is formed. Then, in step 216, it is determined whether or not the data block is ended. If NO, the data block number J is updated in step 218, and the program then proceeds to step 202. Then, the next data block is read to continue the positioning and stitch forming operations.

As mentioned above, the clamp moving means D is movable in the X direction only, and it also serves to transfer the workpiece to the sewing area F. Thus, the mechanism is made simple.

The sewing head A is controlled to be intermittently moved in the Y direction in synchronism with the vertical reciprocal movement of the needle as shown in FIG. 8. In this case, as the inertia of the sewing head A is large, it is hard to completely stop the sewing head upon location of the needle in using the compact Y-axis motor 57, and there is a possibility of the needle moving in the Y direction. However, in this embodiment, the lower horizontal shaft 52 for rotating the loop taker 53 is arranged in parallel to the X-axis, and a beak 53*a* of the loop taker 53 is rotated in a plane parallel to the Y-axis. Therefore, even if the needle is moved in the Y-direction upon location thereof, the beak 53*a* can easily take a loop of thread, thus avoiding failure of catching thread loop.

Further, the movement of the sewing head A may be effected by continuous feed to be carried out by a suitable distribution of pulses. In this case, since the Y-axis motor 57 is continuously rotated, it is advantageous that mechanical vibration and noise may be further suppressed.

Although a preferred embodiment of the invention has been disclosed and described, it is apparent that other embodiments and modifications of the invention may be made within the scope of the appended claims. For example, the following construction may be equivalent to that described above. That is, the moving direction of the feeding plate 9 may inclinedly intersect the moving direction of the sewing head. Further, the X-Y plane may inclinedly intersect the reciprocating direction of the needle. Further, the workpiece supporting table 4 may be inclined relative to the horizontal plane.

What is claimed is:

1. An automatic sewing machine comprising:

a frame having a workpiece supporting surface thereon;

clamp means movably supported on said frame in a first predetermined direction for clamping a workpiece;

a clamp moving motor for moving said clamp means in said first direction;

a sewing head movably supported on said frame in a second direction intersecting said first direction and having a needle and a loop taker cooperating therewith;

a sewing head moving motor for continuously moving said sewing head in said second direction without a stoppage interval during reciprocal movement of said needle; and control means for controlling said clamp moving motor and said sewing head moving motor to cause two-dimensional relative movement between said needle and said workpiece clamped by said clamp means and to form a two-dimensional stitch pattern.

2. An automatic sewing machine as defined in claim 1, wherein said control means comprises memory means for storing stitch data representative of the relative movement, reading means for reading the stitch data from the memory means, and means for controlling said clamp moving motor in synchronism with the reciprocal movement of said needle and controlling said sewing head moving motor to move said sewing head without a stoppage interval during reciprocal movement of said needle based on the stitch data read by said reading means.

3. The automatic sewing machine as defined in claim 2, wherein said first direction is perpendicular to said second direction, and said loop taker is rotated about an X-axis parallel to said first direction, to insure catching of a thread loop.

4. An automatic sewing machine comprising:

a frame having a workpiece supporting surface thereon, said workpiece supporting surface including a sewing area and a preparing area extending from said sewing area in a first predetermined direction where a preparing operation is executed;

clamp means movably supported on said frame in said first direction between said sewing area and said preparing area for clamping a workpiece;

a clamp moving motor for moving said clamp means in said first direction;

a sewing head movably supported on said frame in a second direction intersecting said first direction and having a needle disposed at said sewing area and a loop taker cooperating therewith;

a sewing head moving motor for continuously moving said sewing head in said direction without a stoppage interval during reciprocal movement of said needle;

first control means for controlling said clamp moving motor to transfer said workpiece clamped by said clamp means between said sewing area and said preparing area; and second control means for controlling said clamp moving motor and said sewing head moving motor to cause two-dimensional relative movement between said needle and said workpiece clamped by said clamp means and to form a two-dimensional stitch pattern at said sewing area.

5. An automatic sewing machine as defined in claim 4, wherein said second control means comprises memory means for storing stitch data representative of the relative movement, reading means for reading the stitch data from the memory means, and means for controlling said clamp moving motor in synchronism with the reciprocal movement of said needle and controlling said sewing head moving motor to move said sewing head without a stoppage interval during reciprocal movement of said needle based on the stitch data read by said reading means.

6. The automatic sewing machine as defined in claim 5, wherein said workpiece comprises a work fabric and a pocket piece having a marginal portion to be folded back.

7. The automatic sewing machine as defined in claim 5 further comprising folding means disposed at said preparing area of said workpiece supporting surface for folding back said marginal portion of said pocket piece.

* * * * *

UNITED STATES PATENT AND TRADEMARK OFFICE

CERTIFICATE OF CORRECTION

PATENT NO. : 4,883,006

DATED : November 28, 1989

INVENTOR(S) : Satoshi MORII; Kunihiko MURATA; Hiroyuki MITSUI

It is certified that error appears in the above-identified patent and that said Letters Patent is hereby corrected as shown below: On the title page:

In the "Inventors" section, [75], change "Marii" to --Morii--.

Signed and Sealed this

Ninth Day of October, 1990

*Attest:*

*Attesting Officer*

HARRY F. MANBECK, JR.

*Commissioner of Patents and Trademarks*